US010753564B2

(12) United States Patent
Sakamoto et al.

(10) Patent No.: US 10,753,564 B2
(45) Date of Patent: Aug. 25, 2020

(54) VEHICLE HEADLAMP

(71) Applicant: Panasonic Intellectual Property Management Co., Ltd., Osaka (JP)

(72) Inventors: Yoshinori Sakamoto, Osaka (JP); Kenichiro Mase, Osaka (JP); Takashi Matsuda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/207,242

(22) Filed: Dec. 3, 2018

(65) Prior Publication Data

US 2019/0195453 A1 Jun. 27, 2019

(30) Foreign Application Priority Data

Dec. 25, 2017 (JP) ..... 2017-247127

(51) Int. Cl.

| | |
|---|---|
| ***F21S 41/20*** | (2018.01) |
| ***F21S 41/32*** | (2018.01) |
| ***F21S 41/143*** | (2018.01) |
| ***F21S 41/255*** | (2018.01) |
| ***F21S 41/663*** | (2018.01) |
| ***F21S 41/147*** | (2018.01) |
| ***F21S 41/275*** | (2018.01) |
| *F21W 102/13* | (2018.01) |

(52) U.S. Cl.

CPC ..... *F21S 41/285* (2018.01); *F21S 41/143* (2018.01); *F21S 41/147* (2018.01); *F21S 41/255* (2018.01); *F21S 41/275* (2018.01); *F21S 41/322* (2018.01); *F21S 41/663* (2018.01); *F21W 2102/13* (2018.01)

(58) Field of Classification Search

CPC ..... F21V 5/008; F21V 5/04; B60Q 1/0041; B60Q 1/0011; B60Q 3/62

USPC ..... 362/459–549

See application file for complete search history.

(56) References Cited

U.S. PATENT DOCUMENTS

| | | | | |
|---|---|---|---|---|
| 2008/0253141 | A1* | 10/2008 | Nakada | F21S 41/147 362/507 |
| 2014/0362596 | A1 | 12/2014 | Nakaya | |
| 2017/0122528 | A1 | 5/2017 | Kadoriku et al. | |
| 2017/0292671 | A1* | 10/2017 | Gousset-Rousseau | F21S 41/143 |

(Continued)

FOREIGN PATENT DOCUMENTS

| | | |
|---|---|---|
| CN | 104832859 | 8/2015 |
| EP | 2 357 398 | 8/2011 |
| EP | 2 620 695 | 7/2013 |

(Continued)

OTHER PUBLICATIONS

The Extended European Search Report dated May 29, 2019 for the related European Patent Application No. 18208437.6.

*Primary Examiner* — William J Carter

(74) *Attorney, Agent, or Firm* — Wenderoth, Lind & Ponack, L.L.P.

(57) ABSTRACT

A vehicle headlamp includes a projection lens, a first lens, a second lens, a first light source, and a second light source. The first lens and the second lens are behind the projection lens. The first light source is behind the first lens. The second light source is behind the second lens. The first lens and the second lens deviate from an optical axis of the projection lens and are opposite to each other.

9 Claims, 9 Drawing Sheets

(56) References Cited

U.S. PATENT DOCUMENTS

2017/0356616 A1 12/2017 Schiccheri et al.

FOREIGN PATENT DOCUMENTS

| | | |
|---|---|---|
| EP | 3 388 734 | 10/2018 |
| JP | 2014-241220 | 12/2014 |
| JP | 2016-039110 | 3/2016 |
| JP | 2017-199660 | 11/2017 |
| WO | 2015/198527 | 12/2015 |

* cited by examiner

VEHICLE HEADLAMP

BACKGROUND

1. Technical Field

The present disclosure relates to lighting fixtures for vehicles and buildings, and, in particular, to a vehicle headlamp.

2. Description of the Related Art

In the related art, a vehicle lamp creates a low-beam light distribution pattern and a high-beam light distribution pattern by reflecting light from two light sources by a reflector and a light emitting unit, respectively, and passing the light through a projection lens.

For example, in Japanese Patent Unexamined Publication No. 2016-39110, a low-beam light distribution pattern and a high-beam light distribution pattern are created as shown in FIG. 11. Light emitting unit 30 includes first light source 14 and second light source 32. The low-beam light distribution pattern is formed by reflector 16 emitting light from first light source 14 toward projection lens 12. The high-beam light distribution pattern is formed by light emitting unit 30 emitting light from second light source 32 toward projection lens 12 through light-transmissive member 34.

SUMMARY

There is provided a vehicle headlamp capable of performing irradiation by switching low beam irradiation and high beam irradiation.

The vehicle headlamp includes a projection lens, a first lens, a second lens, a first light source, and a second light source.

The first lens and the second lens are disposed behind the projection lens.

The first light source is disposed behind the first lens.

The second light source is disposed behind the second lens.

The first lens and the second lens are disposed so as to deviate from an optical axis of the projection lens and to be opposite to each other.

The first lens includes a first irradiation port, a first entrance surface, a second entrance surface, a first reflection surface, and a second reflection surface.

The first irradiation port is opposite to an entrance surface of the projection lens.

The first entrance surface is opposite to the first light source and guides the light from the first light source to the first irradiation port.

The second entrance surface is disposed adjacent to the first entrance surface and guides the light failed to pass through the first entrance surface in a direction toward a sidewall of the first lens.

The first reflection surface reflects light entering from the second entrance surface and guides the light to the first irradiation port.

The second reflection surface reflects light passed through the first entrance surface and deflected from a direction toward the first irradiation port and light reflected from the first reflection surface and deflected from the direction toward the first irradiation port, and guides the light to the first irradiation port.

The second lens includes a second irradiation port, a third entrance surface, a fourth entrance surface, a third reflection surface, and a fourth reflection surface.

The second irradiation port is opposite to the entrance surface of the projection lens.

The third entrance surface is opposite to the second light source and guides light from the second light source to the second irradiation port.

The fourth entrance surface is disposed adjacent to the third entrance surface and guides light failed to pass through the third entrance surface in a direction toward a sidewall of the second lens.

The third reflection surface reflects light entering from the fourth entrance surface and guides the light to the second irradiation port.

The fourth reflection surface reflects light passed through the third entrance surface and deflected from a direction toward the second irradiation port and light reflected from the third reflection surface and deflected from the direction toward the second irradiation port, and guides the light to the second irradiation port.

DETAILED DESCRIPTION

In the configuration in the related art, since a light source has a certain size, it is necessary to increase the size of a reflector to a certain size or more in order to correct the influence of aberration of the optical system. Accordingly, the entire size of the vehicle lamps becomes large. When the size of the reflector is reduced, light from the light source leaks from the reflector, and thereby light flux efficiency decreases.

Hereinafter, an exemplary embodiment of the disclosure will be described with reference to the drawings.

Figure 1:
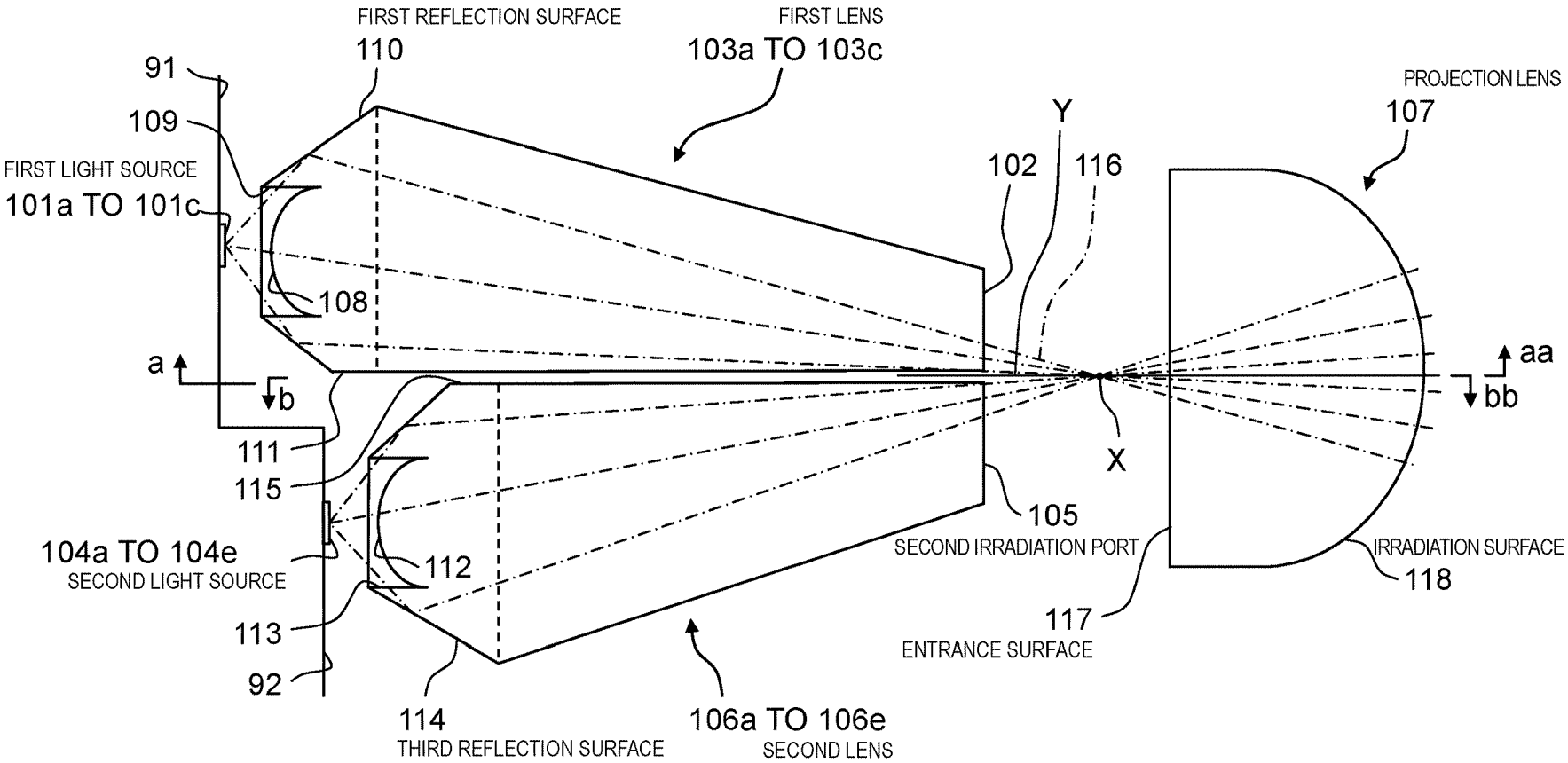
FIG. 1 is a cross-sectional view of a vehicle headlamp according to an exemplary embodiment.
Figure 2:
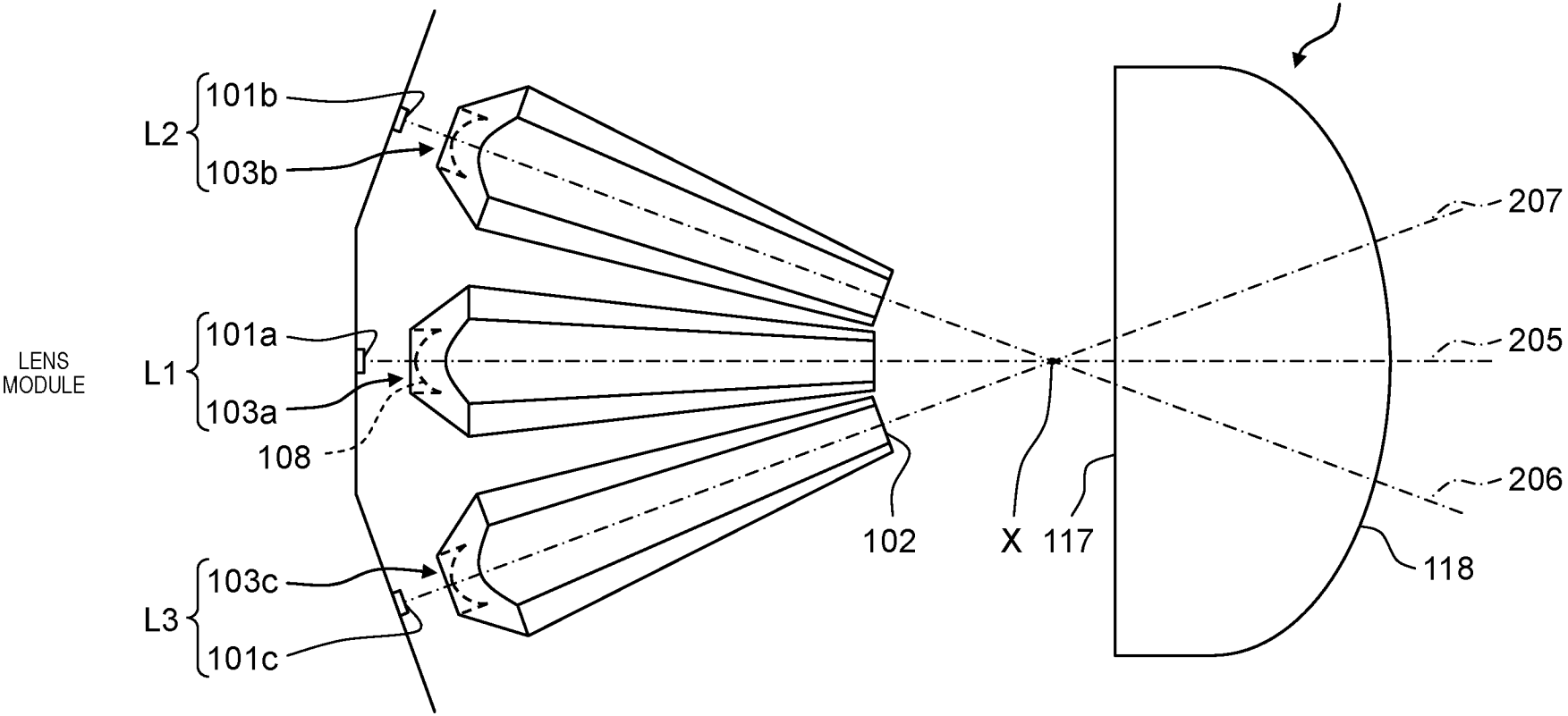
FIG. 2 is a view taken in a direction of a-aa arrow in FIG. 1.
Figure 3:
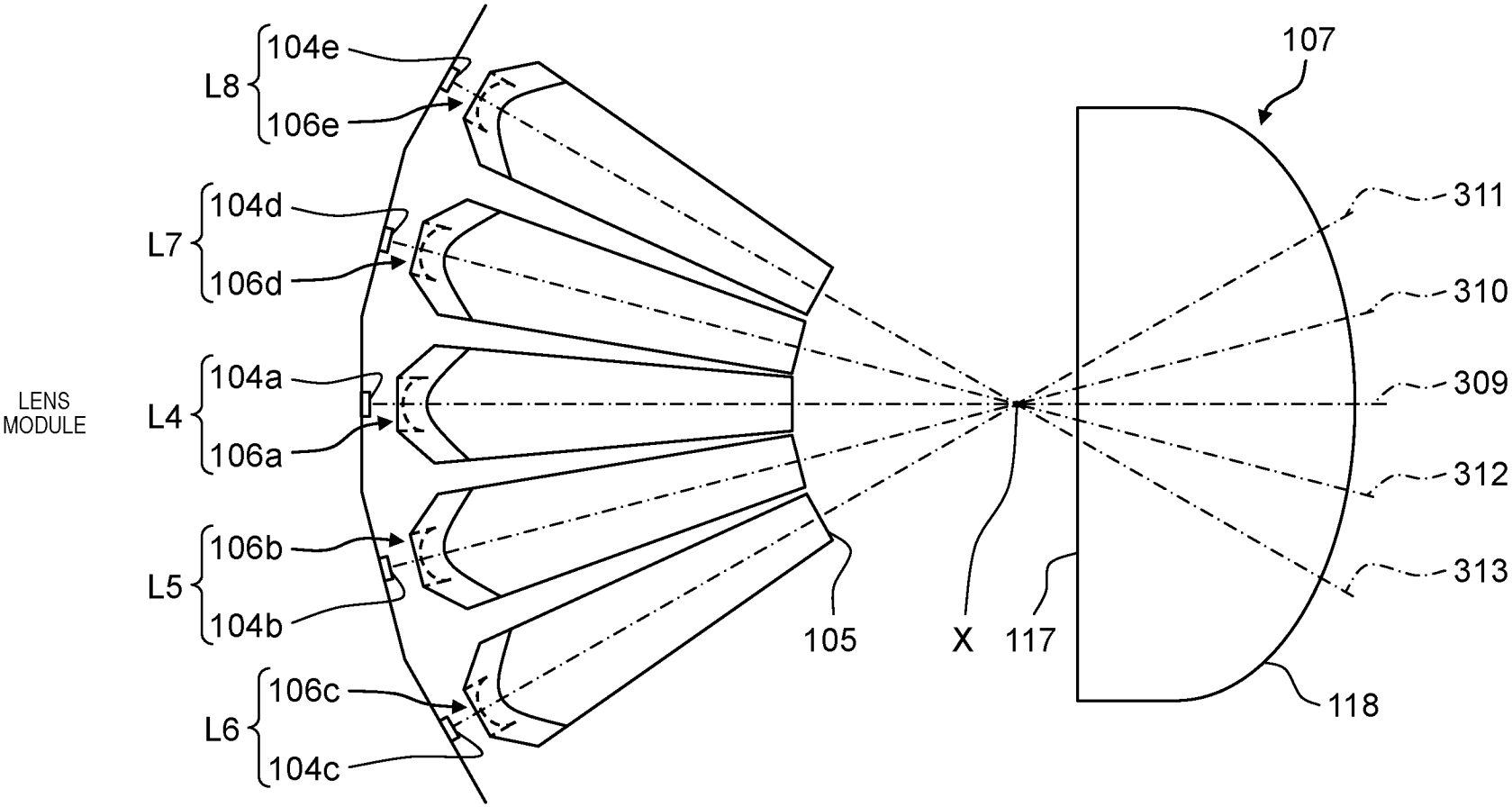
FIG. 3 is a view taken in a direction of b-bb arrow in FIG. 1.
Figure 4:
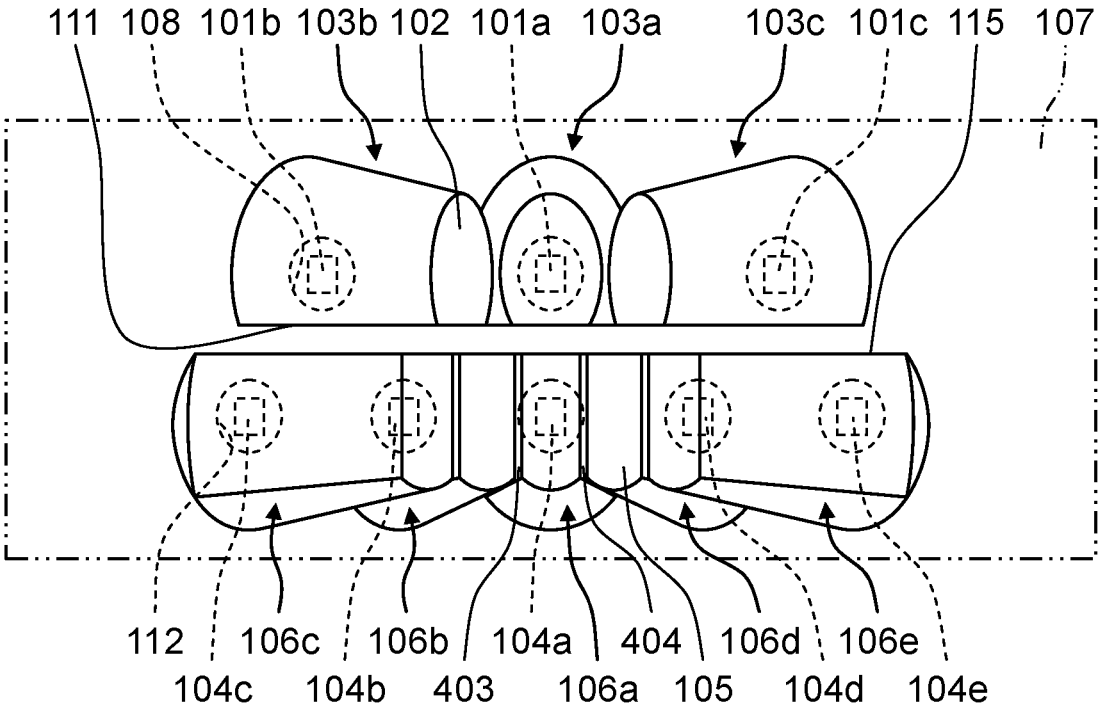
FIG. 4 is a front view of the vehicle headlamp according to the exemplary embodiment.

FIG. 1 is a cross-sectional view of a vehicle headlamp of the present exemplary embodiment. FIG. 2 is a view taken in a direction of a-aa arrow in FIG. 1. FIG. 3 is a view taken in a direction of b-bb in FIG. 1. FIG. 4 is a front view of a vehicle headlamp of the present exemplary embodiment. FIG. 1 is a cross-sectional view, but hatching is omitted in order to show a ray.

Overall Description

The vehicle headlamp of the exemplary embodiment has lens modules L1 to L3 (first lens modules), lens modules L4 to L8 (second lens modules), and projection lens 107. Lens modules L1 to L3 are horizontally arranged. Lens modules L4 to L8 are horizontally arranged below lens modules L1 to L3. Light emitted from lens module L1 to L8 enters projection lens 107. Lens modules L1 to L3 and lens modules L4 to L8 are disposed to deviate from an optical axis Y of projection lens 107. Entire lens modules L1 to L3 and entire lens modules L4 to L8 are opposite to each other as shown in FIGS. 1 and 4. Projection lens 107 is shown in a virtual line in FIG. 4.

Description of Lens Modules L1 to L3

Lens module L1 is configured of first lens 103*a* and first light source 101*a* which emits light toward first entrance surface 108 of first lens 103*a*.

Figure 5A:
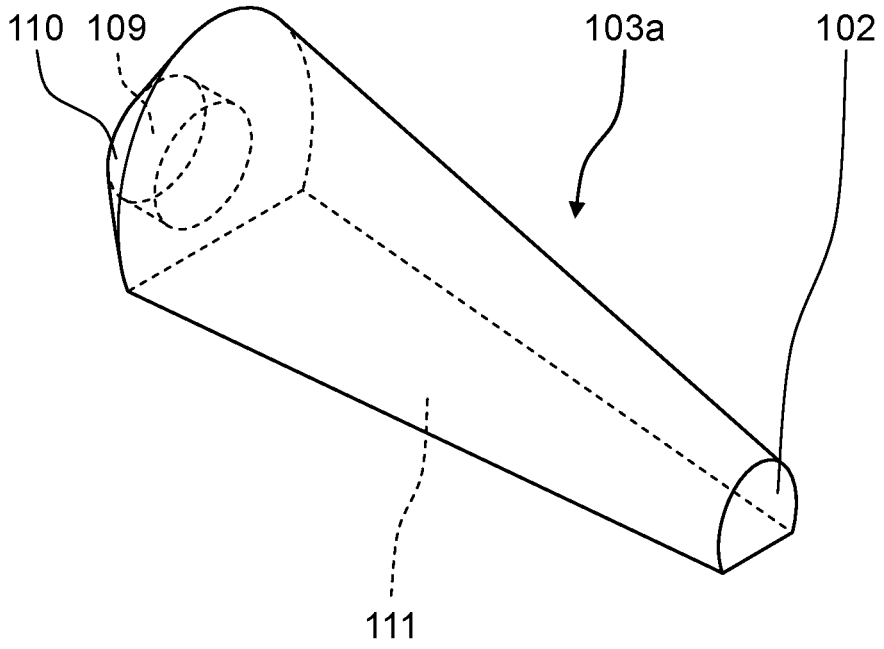
FIG. 5A is a perspective view of a first lens of the vehicle headlamp according to the exemplary embodiment as seen from a first irradiation port.
Figure 5B:
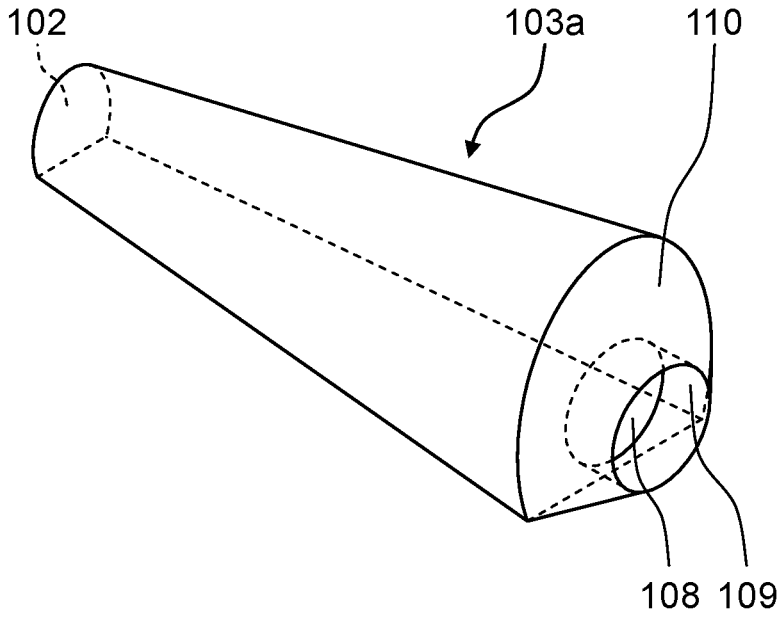
FIG. 5B is a perspective view of the first lens of the vehicle headlamp according to the exemplary embodiment as seen from a first reflection surface.

Lens modules L2 and L3 have the same configuration with lens module L1. Lens module L2 is configured of first lens 103*b* and first light source 101*b* which emits light toward first entrance surface 108 of first lens 103*b*. Lens module L3 is configured of first lens 103*c* and first light source 101*c* which emits light toward first entrance surface 108 of first lens 103*c*. FIGS. 5A and 5B show appearance of first lens 103*a*. First lenses 103*b* and 103*c* also have the same configuration with first lens 103*a*.

Description of Lens Modules L4 to L8

Figure 6A:
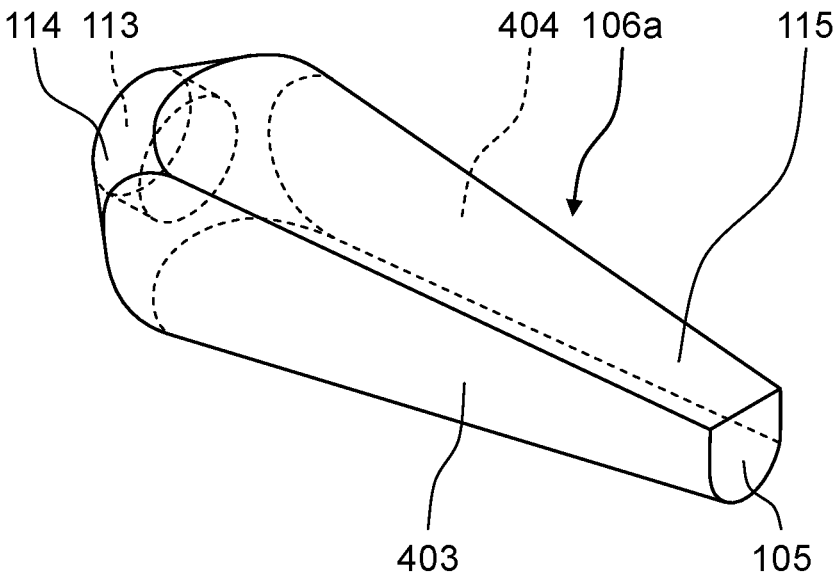
FIG. 6A is a perspective view of a second lens of the vehicle headlamp according to the exemplary embodiment as seen from a second irradiation port.
Figure 6B:
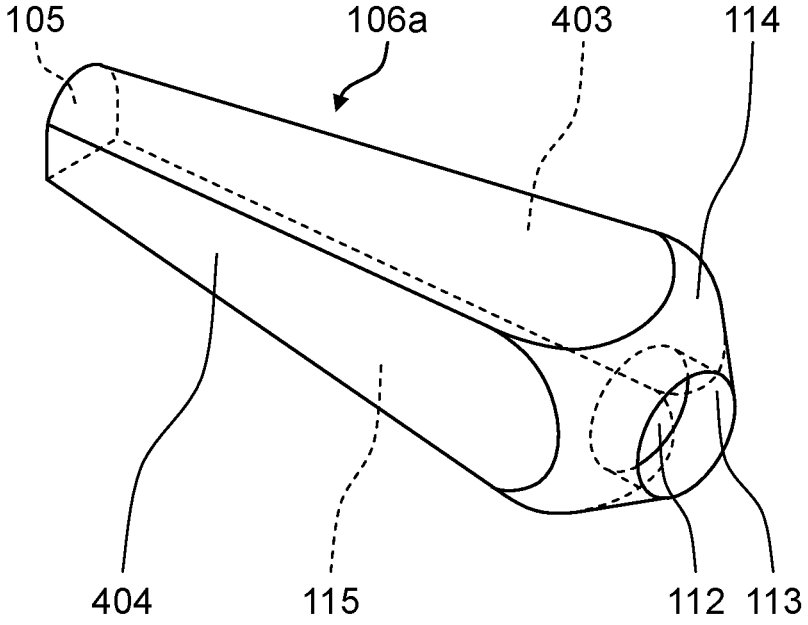
FIG. 6B is a perspective view of the second lens of the vehicle headlamp according to the exemplary embodiment as seen from a third reflection surface.

Lens module L4 is configured of second lens 106*a* and second light source 104*a* which emits light toward third entrance surface 112 of second lens 106*a*. Lens modules L5 to L8 have the same configuration with lens module L4. Lens module L5 is configured of second lens 106*b* and second light source 104*b* which emits light toward third entrance surface 112 of second lens 106*b*. Lens module L6 is configured of second lens 106*c* and second light source 104*c* which emits light toward third entrance surface 112 of second lens 106*c*. Lens module L7 is configured of second lens 106*d* and second light source 104*d* which emits light toward third entrance surface 112 of second lens 106*d*. Lens module L8 is configured of second lens 106*e* and second light source 104*e* which emits light toward third entrance surface 112 of second lens 106*e*. FIGS. 6A and 6B show appearance of second lens 106*a*. Second lenses 106*b* to 106*e* also have the same configuration with second lens 106*a*.

Description of Light Source and Base

First light sources 101*a* to 101*c* are attached to base 91 as shown in FIG. 1. Second light sources 104*a* to 104*e* are attached to base 92 at a position closer to projection lens 107 than base 91.

Detailed Description of Lens Modules L1 to L3

First lenses 103*a* to 103*c* are formed of a light-transmissive light guiding material.

First entrance surface 108 is formed at a center of one end of first lens 103*a* closer to first light source 101*a*. First reflection surface 110 inclined toward a side surface of first lens 103*a* is formed from a periphery of first entrance surface 108 to an outer circumference. Second reflection surface 111 is formed between a side opposite to first reflection surface 110 of first entrance surface 108 and a side surface of first lens 103*a*. First irradiation port 102 is formed at the other end of first lens 103*a*.

First entrance surface 108 of first lens 103*a* guides light from first light source 101*a* to first irradiation port 102. Second entrance surface 109 guides light from first light source 101*a* failed to pass through first entrance surface 108 to a side surface of first lens 103*a*. First reflection surface 110 guides light passed through second entrance surface 109 to first irradiation port 102. Second reflection surface 111 reflects light passed through first entrance surface 108 and deflected from a direction toward first irradiation port 102 and light reflected from first reflection surface 110 and deflected from the direction toward first irradiation port 102 and guides the light to first irradiation port 102. The shapes of first lenses 103*b* and 103*c* are the same as that of first lens 103*a*.

Fan-shaped Arrangement of Lens Modules L1 to L3

Lens modules L1, L2, and L3 are disposed such that light emitted from first light sources 101*a* to 101*c* is guided by first lenses 103*a* to 103*c* to overlap at a point X or a point near the point X as shown in FIGS. 1 and 2. That is, first irradiation ports 102 of first lenses 103*b* and 103*c* approach first irradiation port 102 of first lens 103*a* and are disposed so that intervals of first entrance surfaces 108 of first lenses 103*a* to 103*c* become a spreading fan shape. In other words, first lenses 103*a* to 103*c* are disposed at different angles. The point X is a focal point of projection lens 107 or a position in a vicinity thereof. That is, lens modules L1 to L3 (plurality of first lens modules) are disposed in a fan shape with the point X between first irradiation ports 102 and entrance surface 117 of projection lens 107 as the center point.

Detailed Description of Lens Modules L4 to L8

Second lenses 106*a* to 106*e* are formed of a light-transmissive light guiding material.

Third entrance surface 112 is formed at the center of one end of second lens 106*a* closer to second light source 104*a*. Third reflection surface 114 inclined toward a side surface of second lens 106*a* is formed from a periphery of third entrance surface 112 to an outer circumference. Fourth reflection surface 115 is formed between a side opposite to third reflection surface 114 of third entrance surface 112 and a side surface of second lens 106*a*. Second irradiation port 105 is formed on the other end of first lens 103*a*.

Third entrance surface 112 of second lens 106*a* guides light from second light source 104*a* to second irradiation port 105. Fourth entrance surface 113 guides light from second light source 104*a* failed to pass through third entrance surface 112 to a side surface of second lens 106*a*. Third reflection surface 114 guides light passed through fourth entrance surface 113 to second irradiation port 105. Fourth reflection surface 115 reflects light passed through third entrance surface 112 and deflected from a direction toward second irradiation port 105 and light reflected from third reflection surface 114 and deflected from the direction toward second irradiation port 105 and guides the light to second irradiation port 105. The shapes of second lenses 106*b* to 106*e* are the same as that of second lens 106*a*.

Fan-Shaped Arrangement of Lens Modules L4 to L8

Lens modules L4 to L8 are disposed such that light emitted from second light sources 104*a* to 104*e* is guided by second lenses 106*a* to 106*e* to overlap at the point X or a point near the point X as shown in FIGS. 1 and 3. That is, second irradiation ports 105 of second lenses 106*b* to 106*e* approach second irradiation port 105 of second lens 106*a*, and are disposed at different arrangement angles so that intervals of third entrance surfaces 112 of second lenses 106*a* to 106*e* become a spreading fan shape. In other words, second lenses 106*b* to 106*e* are disposed at different angles. The point X is a focal point of projection lens 107 or a position in a vicinity thereof. That is, lens modules L4 to L8 (plurality of second lens modules) are disposed in a fan shape with the point X between second irradiation ports 105 and entrance surface 117 of projection lens 107 as the center point.

Projection Lens 107

Projection lens 107 has entrance surface 117 on which ray 116 passed through first lenses 103*a* to 103*c* and second lenses 106*a* to 106*e* is incident and irradiation surface 118 that emits incident ray 116. A wave-like or conical periodic structure is formed on irradiation surface 118.

Optical Axis of First Lens and Optical Axis of Second Lens

Light emitted from first light sources 101*a* to 101*c* is guided by first lenses 103*a* to 103*c* and exits through projection lens 107. The light emitted from second light sources 104*a* to 104*e* is guided by second lenses 106*a* to 106*e* and exits through projection lens 107. Optical axes 205 to 207 of first lenses 103*a* to 103*c* and optical axes 309 to 313 of second lenses 106*a* to 106*e* are designed to intersect at the common point X in front of first irradiation ports 102 and second irradiation ports 105 or at a point in a vicinity thereof.

Since the focal point of projection lens 107 is set to coincide with the point X or a point in the vicinity of the point X, it is possible to emit both light exit from first light sources 101*a* to 101*c* and guided by first lenses 103*a* to 103*c* and light exit from second light sources 104*a* to 104*e* and guided by second lenses 106*a* to 106*e* as substantially parallel light.

Sidewall of First Lens

A shape of second reflection surface 111 (sidewall) of first lenses 103*a* to 103*c* shown in FIG. 4 is designed so that the light emitted from first irradiation ports 102 is in any shape by reflecting light entering first lenses 103*a* to 103*c* from first light sources 101*a* to 101*c*. Second reflection surface 111 is a plane opposite to second lenses 106*a* to 106*e*.

Sidewall of Second Lens

Shapes of fourth reflection surface 115, sidewalls 403 and 404 of second lenses 106*a* to 106*e* shown in FIG. 4 are designed so that the light emitted from second irradiation ports 105 is in any shape by reflecting the light entering second lenses 106*a* to 106*e* from second light sources 104*a* to 104*e*. Fourth reflection surface 115 is a plane opposite to first lenses 103*a* to 103*c*. Sidewalls 403 and 404 are planes opposite to an adjacent second lens.

As described above, first lenses 103*a* to 103*c* and first light sources 101*a* to 101*c* are disposed in a horizontal direction with a certain interval therebetween. Furthermore, second lenses 106*a* to 106*e* and second light sources 104*a* to 104*e* are disposed in a horizontal direction with a certain interval therebetween. By superimposing the respective light distributions, the intended light distribution irradiation can be realized.

In the configuration of the present exemplary embodiment, optical axes of first lenses 103*a* to 103*c* and second lenses 106*a* to 106*e* are disposed so as to intersect each other. It is possible to perform irradiation of at least two distribution patterns of low beam irradiation and high beam irradiation without using a reflector by turning on and turning off first light sources 101*a* to 101*c* and second light sources 104*a* to 104*e*. Therefore, it is possible to realize a small and thin vehicle headlamp while forming a highly efficient irradiation light distribution.

In the above-described configuration, it is possible to prevent concentrated generation of heat by using plurality of lens modules L1 to L3 and L4 to L8 when forming a light distribution pattern. Therefore, a vehicle headlamp not requiring a special heat dissipation mechanism can be realized.

In the present exemplary embodiment, plurality of second lenses 106*a* to 106*e* and plurality of second light sources 104*a* to 104*e* are disposed in a fan shape while being shifted in angle with respect to the point X or a vicinity thereof. Accordingly, light that exits from plurality of second light sources 104*a* to 104*e*, respectively and is guided by plurality of second lenses 106*a* to 106*e* can be collected at the vicinity of the point X. Furthermore, a space at the vicinity of second light sources 104*a* to 104*e* and third entrance surface 112, fourth entrance surface 113, and third reflection surface 114 of second lenses 106*a* to 106*e* can be enlarged.

It is possible to prevent concentrated generation of heat caused by second light sources 104*a* to 104*e* by enlarging the space at the vicinity of second light sources 104*a* to 104*e*. By enlarging third entrance surface 112, fourth entrance surface 113, and third reflection surface 114 of second lenses 106*a* to 106*e*, it is possible to guide more light emitted from second light sources 104*a* to 104*e*, and to achieve high efficiency.

A certain interval is provided when disposing first lenses 103*a*, 103*b*, and 103*c* in the parallel direction. However, first lenses 103*a*, 103*b*, and 103*c* may be integrated without providing any intervals. A certain interval is provided when disposing second lenses 106*a* to 106*e*. However, second lenses 106*a* to 106*e* may be integrated without providing any intervals. In the present exemplary embodiment, second lenses 106*a* to 106*e* and second light sources 104*a* to 104*e* are disposed at the same distance from the vicinity of the point X. However, second lenses 106*a* to 106*e* and second light sources 104*a* to 104*e* may not be disposed at the same distance. First lenses 103*a*, 103*b*, and 103*c* and first light sources 101*a*, 101*b*, and 101*c* may not be disposed at the same distance.

Plurality of second lenses 106*a* to 106*e*, plurality of second light sources 104*a* to 104*e*, and plurality of optical axes 309 to 313 created by the second lenses and the second light sources are disposed in a fan shape with the point X or the vicinity thereof as the center while being shifted in angle. Here, the shifted angles may be the same angle or may be different angles. This also applies to first lenses 103*a*, 103*b*, and 103*c*, first light sources 101*a*, 101*b*, and 101*c*, and plurality of optical axes 205 to 207 created by the first lenses and the first light sources.

The material of the lens may be inorganic glass or an organic plastic represented by acrylic or polycarbonate. It is possible to realize a lens configuration that enables thinning without using a reflector with this arrangement. Therefore, the problem of the vehicle headlamp that the size increases and the efficiency is lowered is solved.

Light Distribution Pattern

The light distribution of the vehicle headlamp will be described with reference to FIGS. 2, 3, and 6A to 10.

Figure 7:
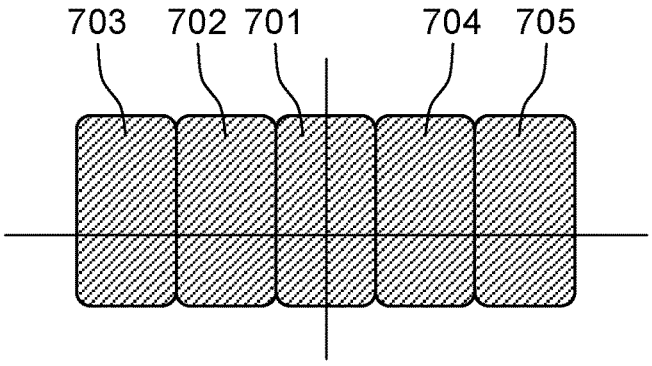
FIG. 7 is a diagram showing an irradiation light distribution pattern.

FIG. 3 is a view taken in a direction of b-bb in FIG. 1. The light emitted from second light sources 104*a* to 104*e* passes through second lenses 106*a* to 106*e*, exits from second irradiation port 105, enters entrance surface 117 of projection lens 107, and is emitted from irradiation surface 118. Second light sources 104*a* to 104*e*, second lenses 106*a* to 106*e*, and projection lens 107 are disposed so as to form such an optical path. FIG. 7 shows an example (irradiation light distribution pattern 1) of the light distribution of emitted light when second light sources 104*a* to 104*e* are turned on. Light distribution range 701 is a light distribution range of emitted light when second light source 104*a* is turned on. Light distribution range 702 is a light distribution range of emitted light when second light source 104*b* is turned on. Light distribution range 703 is a light distribution range of emitted light when second light source 104*c* is turned on. Light distribution range 704 is a light distribution range of emitted light when second light source 104*d* is turned on. Light distribution range 705 is a light distribution range of emitted light when second light source 104*e* is turned on.

Figure 8:
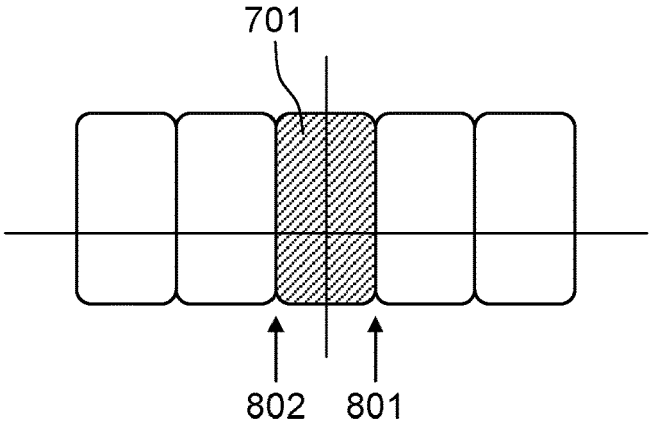
FIG. 8 is a diagram showing an irradiation light distribution pattern.

When a front vehicle such as an oncoming vehicle or a foregoing vehicle appears while traveling with irradiation light distribution pattern 1 of FIG. 7, it is possible to travel without giving a glare to the driver of the front vehicle by turning on and off second light sources 104*a* to 104*e* according to the position of the vehicle. FIG. 8 shows an example (irradiation light distribution pattern 2) of light distribution range 701 of emitted light when second light source 104*a* is turned on and second light sources 104*b* to 104*e* are turned off. Right boundary line 801 of the light distribution is formed by reflecting the light traveling toward sidewall 403 among light entered from second light source 104*a* to second lens 106*a*. Left boundary line 802 of the light distribution is formed by reflecting the light traveling toward sidewall 404 among the light entered from second light source 104*a* to second lens 106*a*.

Figure 9:
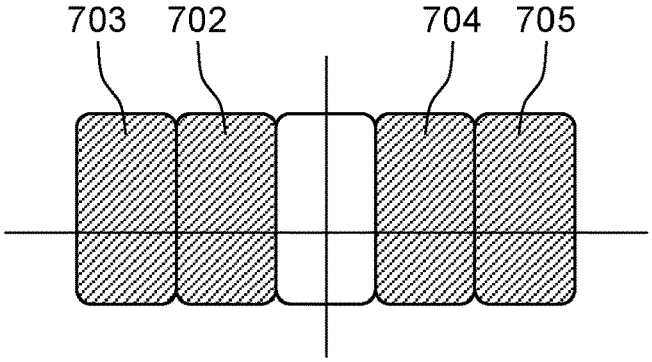
FIG. 9 is a diagram showing an irradiation light distribution pattern.

FIG. 9 shows an example (irradiation light distribution pattern 3) of light distributions 702, 703, 704, and 705 of emitted light when second light sources 104*b*, 104*c*, 104*d*, and 104*e* are turned on and second light source 104*a* is turned off.

Figure 10:
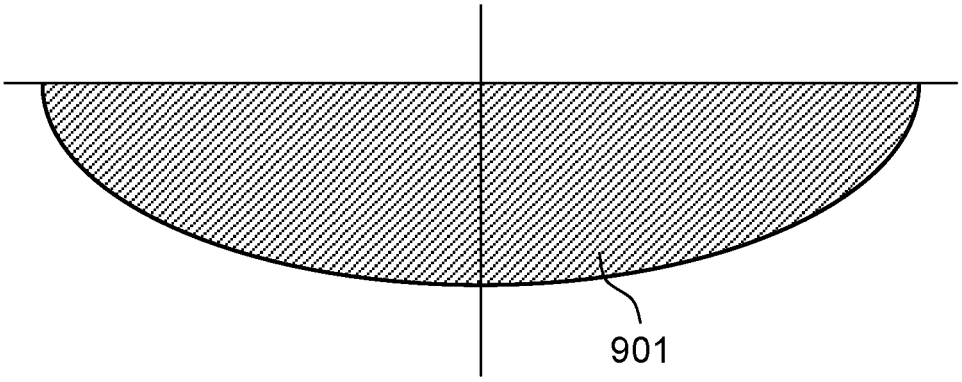
FIG. 10 is a diagram showing an irradiation light distribution pattern.
Figure 11:
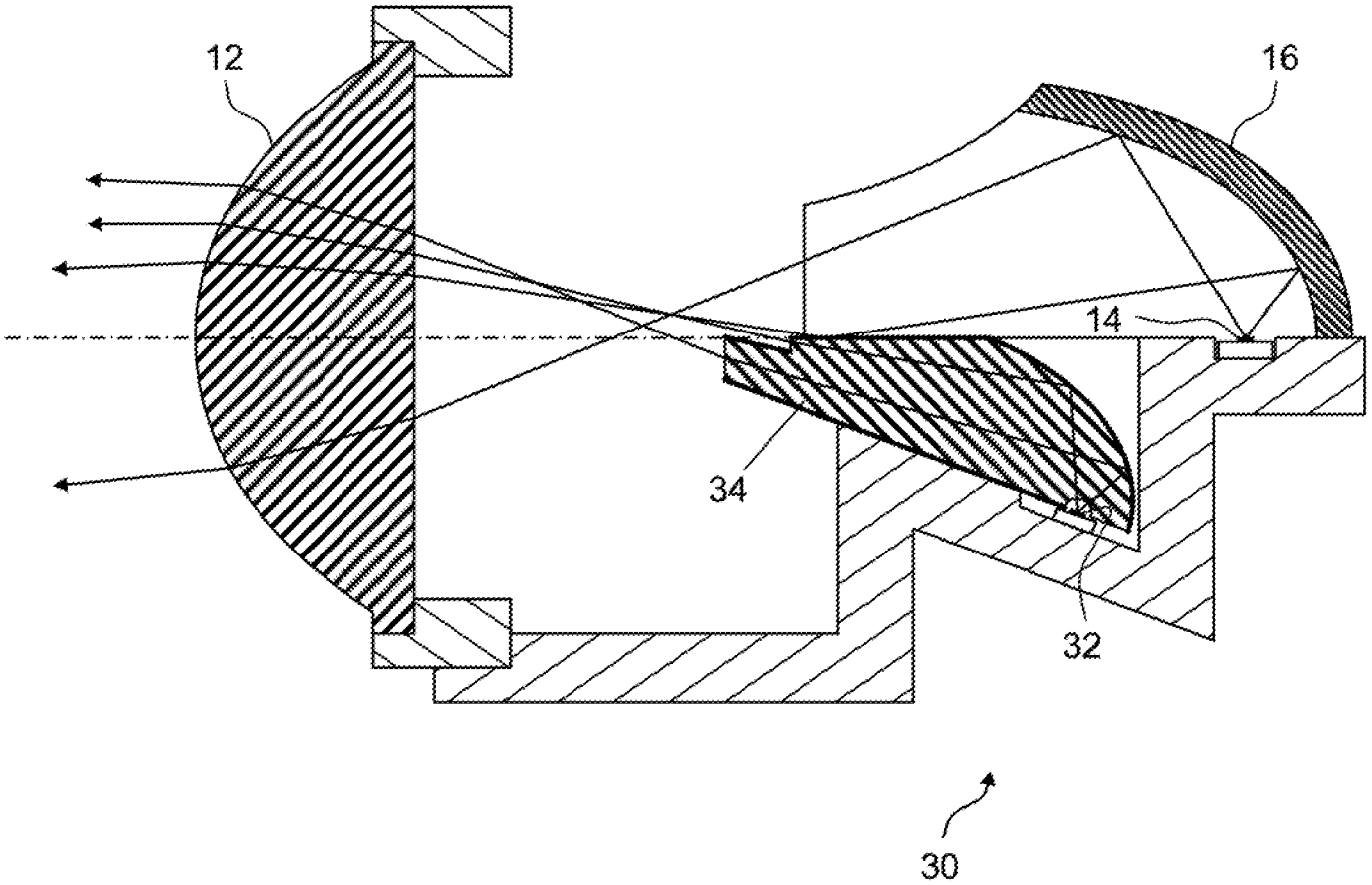
FIG. 11 PRIOR ART
FIG. 11 is a cross-sectional view of a vehicle headlamp in the related art.

FIG. 10 shows an example (irradiation light distribution pattern 4) of light distribution pattern 901 of emitted light when first light sources 101*a*, 101*b*, and 101*c* are turned on. In the present exemplary embodiment, light distribution pattern 901 as shown in FIG. 10 formed by irradiation of first light sources 101*a*, 101*b*, and 101*c* is an example of a low-beam light distribution pattern. The irradiation light distribution pattern 1 in FIG. 7 formed by irradiation of second light sources 104*a* to 104*e* is an example of a high-beam light distribution pattern.

Since there are many oncoming vehicles when traveling in the city, the irradiation time of the low-beam light distribution pattern formed by irradiation of first light sources 101*a* to 101*c* is longer than that of the high-beam light distribution pattern formed by irradiation of second light sources 104*a* to 104*e*.

That is, the heat generated when first light sources 101*a* to 101*c* emit light increases. In the present exemplary embodiment, first lenses 103*a* to 103*c* are designed to be longer than second lenses 106*a* to 106*e*, and the lenses themselves take the place of the heat dissipation mechanism. Therefore, it has a configuration capable of dissipating heat generated when first light sources 101*a* to 101*c* emit light.

In the above-described exemplary embodiment, three lens modules L1 to L3 of first light sources 101*a* to 101*c* and first lenses 103*a* to 103*c* and five lens modules L4 to L8 of second light sources 104*a* to 104*e* and second lenses 106*a* to 106*e* are used, but they may not be three or five.

According to the configuration of the present exemplary embodiment, the first lenses and the second lenses are disposed so as to be shifted from the optical axis of the projection lens and to be opposite to each other, and the light emitted from the first lenses and the second lenses is emitted through the projection lens. Therefore, the pattern of the light distribution can be switched by switching lighting of the first light sources and the second light sources.

The vehicle headlamp in the related art illuminates with a light distribution pattern using a reflector. However, since the vehicle headlamp of the present exemplary embodiment does not use the reflector, it can be made thinner than the vehicle headlamp in the related art. That is, the vehicle headlamp of the present exemplary embodiment can be made small and thin while the light flux forms irradiation light distribution with high efficiency.

The present disclosure is to provide a small and thin lighting fixture capable of switching projected light distributions with high efficiency and can be applied to not only vehicles but also to the use of lighting fixtures for other vehicles and buildings.

What is claimed is:

1. A vehicle headlamp that is capable of performing irradiation by switching low beam irradiation and high beam irradiation, the vehicle headlamp comprising:

a projection lens;

a first lens and a second lens that are behind the projection lens;

a first light source that is behind the first lens; and a second light source that is behind the second lens, wherein the first lens and the second lens deviate from an optical axis of the projection lens and are opposite to each other, wherein the first lens includes:

a first irradiation port that is opposite to an entrance surface of the projection lens, a first entrance surface that is opposite to the first light source and configured to guide light from the first light source to the first irradiation port;

a second entrance surface that is adjacent to the first entrance surface and configured to guide light which has failed to pass through the first entrance surface in a direction toward a sidewall of the first lens;

a first reflection surface that is configured to reflect light entering from the second entrance surface and guide the light to the first irradiation port; and a second reflection surface that is configured to reflect light which has passed through the first entrance surface and been deflected from a direction toward the first irradiation port and light which has been reflected from the first reflection surface and deflected from a direction toward the first irradiation port, and guide the light to the first irradiation port; and wherein the second lens includes:

a second irradiation port that is opposite to the entrance surface of the projection lens;

a third entrance surface that is opposite to the second light source and configured to guide light from the second light source to the second irradiation port;

a fourth entrance surface that is adjacent to the third entrance surface and configured to guide light which has failed to pass through the third entrance surface in a direction toward a sidewall of the second lens;

a third reflection surface that is configured to reflect light entering from the fourth entrance surface and guide the light to the second irradiation port; and a fourth reflection surface that is configured to reflect light which has passed through the third entrance surface and been deflected from a direction toward the second irradiation port and light which has been reflected from the third reflection surface and deflected from a direction toward the second irradiation port, and guide the light to the second irradiation port, and wherein an entirety of the second reflection surface is planar and an entirety of the fourth reflection surface is planar such that the entirety of the second reflection surface and the entirety of the fourth reflection surface are parallel planes that are opposite to each other and physically separated.

2. The vehicle headlamp of claim 1, wherein a first lens module includes the first light source and the first lens, wherein a second lens module includes the second light source and the second lens, wherein the first lens module is one of a plurality of first lens modules, wherein the second lens module is one of a plurality of second lens modules, wherein the plurality of first lens modules are in a first fan shape with a point between the first irradiation ports of the plurality of first lens modules and the entrance surface of the projection lens as a center point, and wherein the plurality of second lens modules are in a second fan shape with a point between the second irradiation ports of the plurality of second lens modules and the entrance surface of the projection lens as the center point.

3. The vehicle headlamp of claim 1, wherein the first lens is one of a plurality of first lenses, wherein the second lens is one of a plurality of second lenses, wherein optical axes of the plurality of first lenses intersect each other at a point between the first irradiation ports of the plurality of first lenses and the entrance surface of the projection lens, wherein optical axes of the plurality of second lenses intersect each other at a point between the second irradiation ports of the plurality of second lenses and the entrance surface of the projection lens, and wherein the projection lens is configured such that rays from the plurality of first lenses and rays from the plurality of second lenses enter the projection lens.

4. The vehicle headlamp of claim 1, wherein the projection lens is configured to emit a ray from the first irradiation port of the first lens and a ray from the second irradiation port of the second lens.

5. The vehicle headlamp of claim 1, wherein the vehicle headlamp is configured such that light distribution formed by the first lens and light distribution formed by the second lens are switched by switching lighting of the first light source and the second light source.

6. The vehicle headlamp of claim 1, wherein a first lens module includes the first light source and the first lens, wherein a second lens module includes the second light source and the second lens, wherein the first lens module is one of a plurality of first lens modules, wherein the second lens module is one of a plurality of second lens modules, and wherein the first light sources of the plurality of first lens modules and the second light sources of the plurality of second lens modules are configured such that a plurality of light distribution patterns are displayed by switching lighting of the first light sources of the plurality of first lens modules and the second light sources of the plurality of second lens modules.

7. The vehicle headlamp of claim 6, wherein optical axes of the plurality of first lens modules and optical axes of the plurality of second lens modules intersect each other at a point between the first irradiation ports of the plurality of first lens modules and the projection lens, and between the second irradiation ports of the plurality of second lens modules and the projection lens, and wherein the projection lens is configured such that rays from the plurality of first lens modules and rays from the plurality of second lens modules enter the projection lens.

8. The vehicle headlamp of claim 6, wherein the plurality of first lens modules are in a fan shape with a point between the first irradiation ports of the first lens modules and the entrance surface of the projection lens as a center point.

9. The vehicle headlamp of claim 6, wherein the plurality of second lens modules are in a fan shape with a point between the second irradiation ports of the second lens modules and the entrance surface of the projection lens as a center point.

* * * * *